US008477128B2

(12) United States Patent
Yang et al.

(10) Patent No.: US 8,477,128 B2
(45) Date of Patent: Jul. 2, 2013

(54) DRIVING CIRCUIT FOR LIQUID CRYSTAL PIXEL ARRAY AND LIQUID CRYSTAL DISPLAY USING THE SAME

(75) Inventors: Wen-Lin Yang, Sinshih Township, Tainan County (TW); Chih-Lung Kuo, Sinshih Township, Tainan County (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 370 days.

(21) Appl. No.: 12/913,156

(22) Filed: Oct. 27, 2010

(65) Prior Publication Data

US 2012/0105406 A1 May 3, 2012

(51) Int. Cl.
*G09G 5/00* (2006.01)

(52) U.S. Cl.
USPC ..... 345/209

(58) Field of Classification Search
USPC ..... 345/209, 212, 96
See application file for complete search history.

(56) References Cited

U.S. PATENT DOCUMENTS 6,014,122 A * 1/2000 Hashimoto ..... 345/98
6,762,565 B2 * 7/2004 Kudo et al. ..... 315/169.2

* cited by examiner

*Primary Examiner* — William Boddie
*Assistant Examiner* — Leonid Shapiro
(74) *Attorney, Agent, or Firm* — McClure, Qualey & Rodack, LLP

(57) ABSTRACT

A driving circuit and a liquid crystal display using the same. In the driving circuit, a first switch and a second switch are provided in a VCOM driver thereof. The first switch is designed to be turned on to a ground a VCOM terminal of a display capacitor, and the second switch is designed to be turned on to couple a constant voltage level DC VCOM to the VCOM terminal of the display capacitor. In addition, a timing controller of the driving circuit is designed for reducing power consumption, which controls the statuses of the first and second switches and determines when to allow a positive polarity voltage to be coupled to the display capacitor to charge the display capacitor for positive polarity display.

10 Claims, 7 Drawing Sheets

DRIVING CIRCUIT FOR LIQUID CRYSTAL PIXEL ARRAY AND LIQUID CRYSTAL DISPLAY USING THE SAME

BACKGROUND OF THE INVENTION

1. Field of the Invention

The present invention relates to a liquid crystal display (LCD), and in particular relates to a driving circuit driving a liquid crystal pixel array of the LCD.

2. Description of the Related Art

A liquid crystal display (LCD) is a thin, flat electronic visual display that uses the light modulating properties of liquid crystals. Liquid crystals do not emit light directly. An image is displayed by controlling the transmission of the liquid crystals.

For each liquid crystal pixel, it is only the magnitude of the applied voltage that determines the light transmission. To prevent polarization (and rapid permanent damage) of the liquid crystal material, the polarity of the applied voltage is reversed on alternate video frames. Several polarity inversion techniques have been developed, which include line inversion, dot inversion and column inversion.

For polarity inversion, a common voltage is required. When the applied voltage is greater than the common voltage, a positive polarity display is provided. On the contrary, when the applied voltage is lower than the common voltage, a negative polarity display is provided. For the dot inversion (as shown in FIG. 1A) or column inversion (as shown in FIG. 1B) techniques, the polarity of each pixel is reversed in each frame, and two adjacent pixels (such as a first pixel P1 and a second pixel P2) located in the same row and adjacent columns are always of opposite polarities. Because the pixels, such as the first and second pixels P1 and P2, in the same row may share the same common voltage, the common voltage has to be fixed to a constant value and is known as a DC VCOM. However, a constant DC VCOM may cause redundant power consumption in the driving circuit; which is discussed and reduced in the embodiments of the invention.

BRIEF SUMMARY OF THE INVENTION

Liquid crystal displays (LCDs) and driving circuits thereof are disclosed.

The driving circuit is operative to drive a liquid crystal pixel array of the LCD, and comprises at least a source driver, a VCOM driver and a timing controller.

The source driver comprises a first source operational amplifier. The first source operational amplifier couples a positive polarity display voltage to a first terminal of a first display capacitor of the liquid crystal pixel array when a first pixel, within the liquid crystal pixel array and providing the first display capacitor, is scanned for positive polarity display and a coupling between the positive polarity display voltage and the first terminal of the first display capacitor is allowed.

The VCOM driver comprises a VCOM operational amplifier, a first switch and a second switch. The VCOM operational amplifier outputs a DC VCOM. When turned on, the first switch couples a second terminal of the first display capacitor to a ground. As for the second switch, it is designed to be turned on to couple the DC VCOM (output from the VCOM operational amplifier) to the second terminal of the first display capacitor.

The timing controller is designed for reducing power consumption. The timing controller determines when to allow the coupling between the positive polarity display voltage and the first terminal of the first display capacitor, and further controls the statuses of the first and second switches.

In an exemplary embodiment, the timing controller turns on the first switch and turns off the second switch when the coupling between the positive polarity display voltage and the first terminal of the first display capacitor is established. The timing controller keeps turning on the first switch and keeps turning off the second switch until the coupling between the positive polarity display voltage and the first terminal of the first display capacitor is broken. In some embodiments, the timing controller further turns on the first switch and turns off the second switch to discharge the first display capacitor to a zero voltage.

To couple the positive polarity display voltage to the first terminal of the first display capacitor, the first source operational amplifier may be powered by a positive supply voltage and a power ground. To output the DC VCOM, the VCOM operational amplifier may be powered by the power ground and a negative supply voltage.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following descriptions show several embodiments carrying out the invention. This description is made for the purpose of illustrating the general principles of the invention and should not be taken in a limiting sense. The scope of the invention is best determined by reference to the appended claims.

Figure 1A:
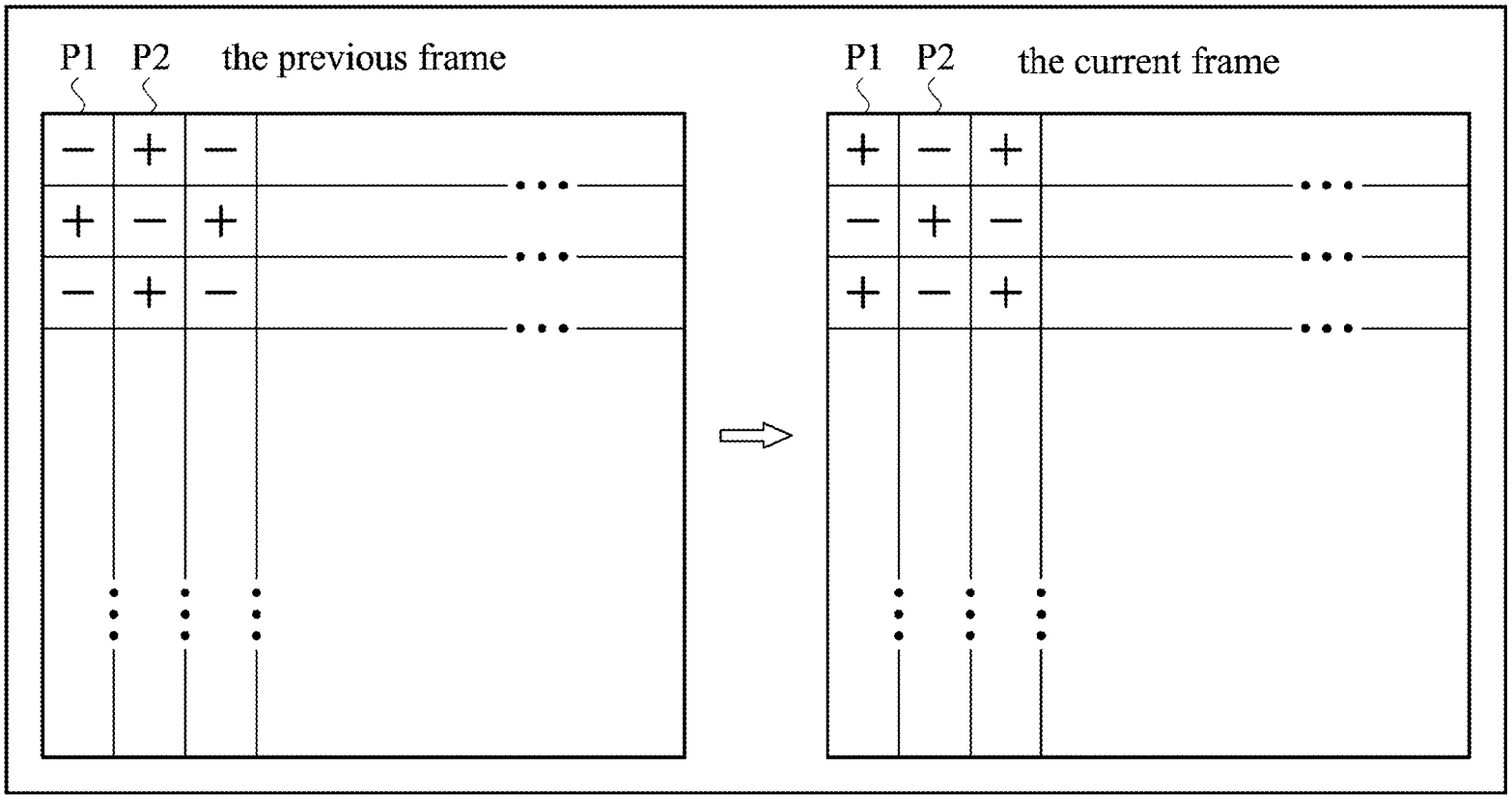
FIG. 1A (PRIOR ART)
FIG. 1A illustrates a dot inversion technique.
Figure 1B:
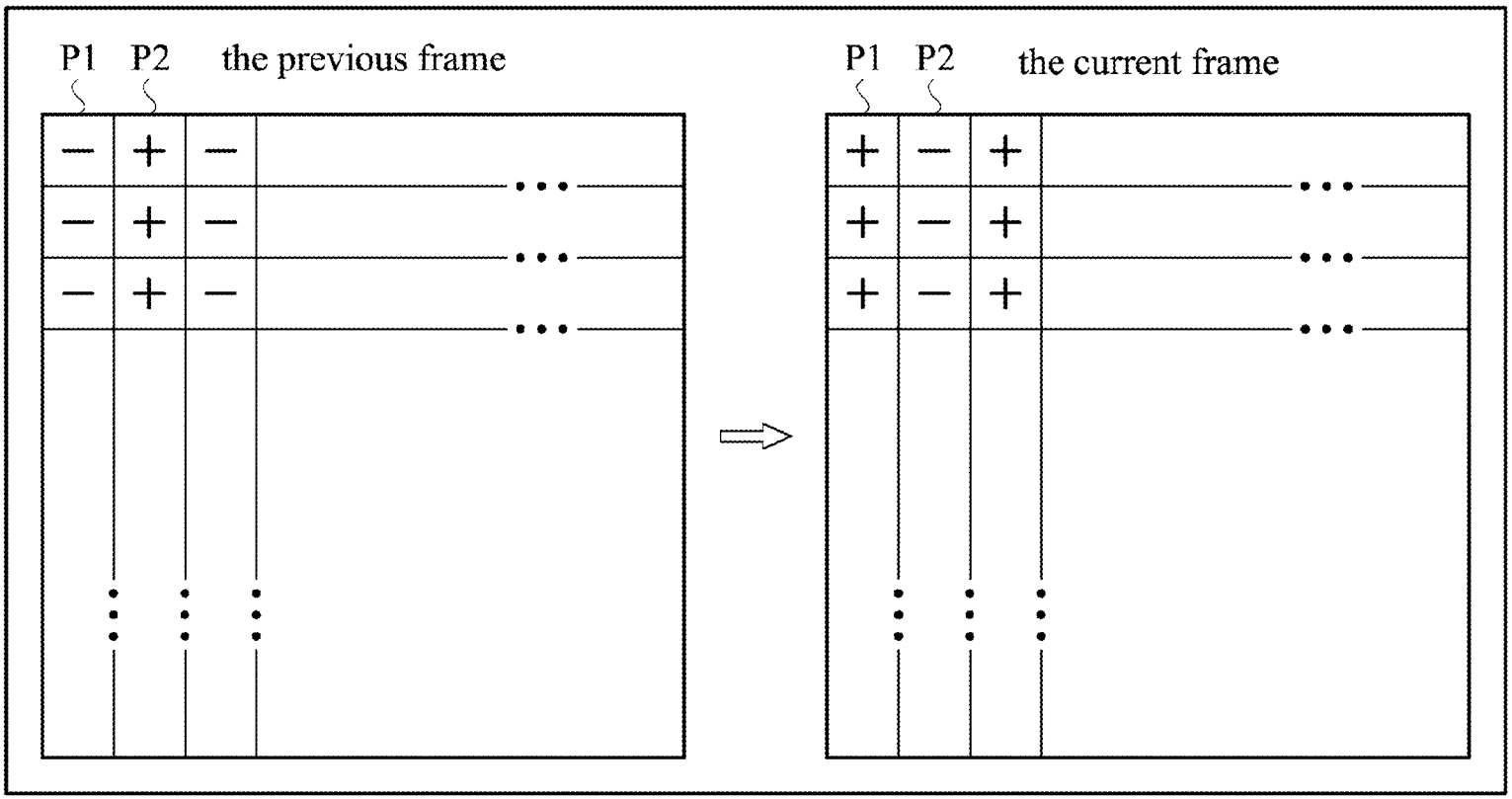
FIG. 1B (PRIOR ART)
FIG. 1B illustrates a column inversion technique.
Figure 2:
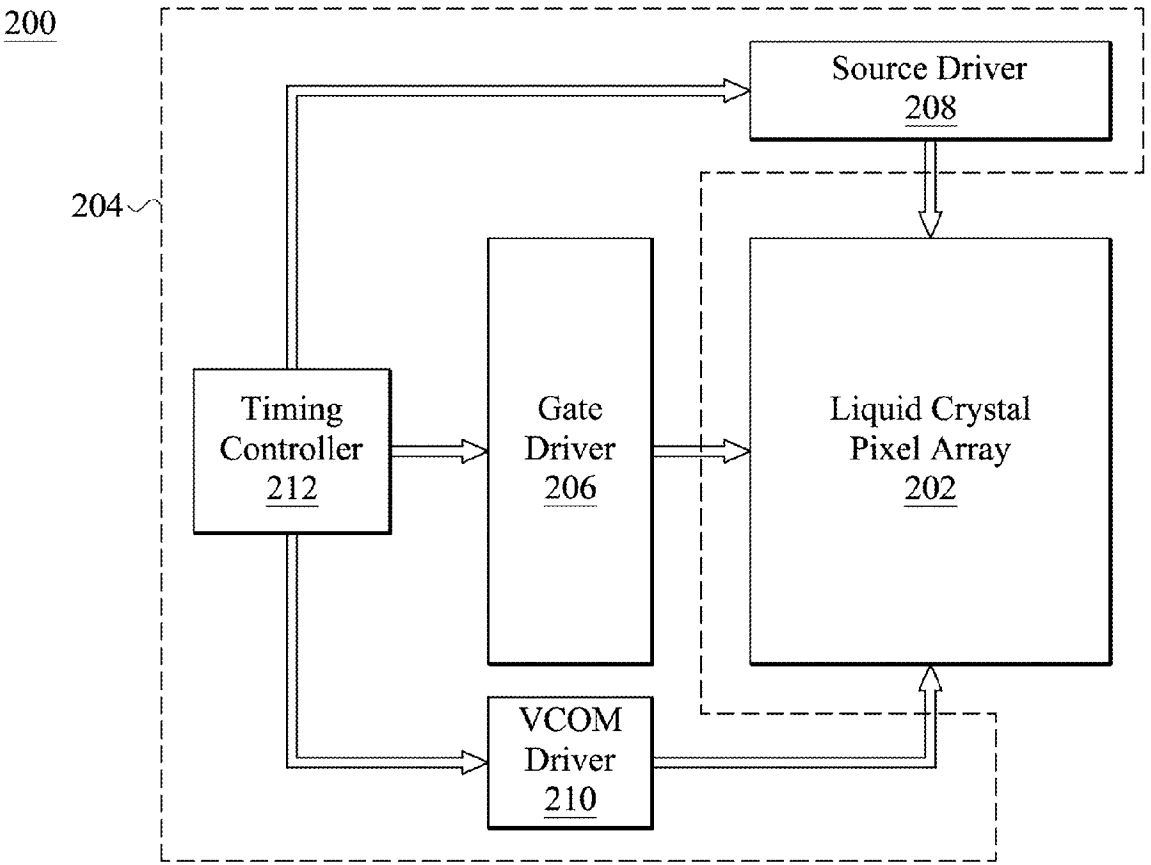
FIG. 2 is a block diagram illustrating a liquid crystal display 200 according to an embodiment of the invention.

FIG. 2 is a block diagram illustrating a liquid crystal display 200 according to an embodiment of the invention. The liquid crystal display 200 comprises a liquid crystal pixel array 202 and a driving circuit 204. The driving circuit 204 comprises a gate driver 206, a source driver 208, a VCOM driver 210 and a timing controller 212. The gate driver 206 is controlled by the timing controller 212 to scan the liquid crystal pixel array 202 row by row. The source driver 208 is controlled by the timing controller 212 to provide the scanning pixels with display voltages. The VCOM driver 210 is controlled by the timing controller 212 to provide the liquid crystal pixel array 202 with a common voltage (VCOM). In the invention, the circuit of the VCOM driver 210 and a control scheme provided by the timing controller 212 are specially designed for reducing power consumption.

For simplicity, the driving circuit discussed herein only relates to two adjacent pixels (in the same row and adjacent columns) of the liquid crystal pixel array 202. However, it is not intended to limit the scope of the invention. The disclosed structure may be extended by those skilled in the art to control the total liquid crystal pixel array.

Figure 3A:
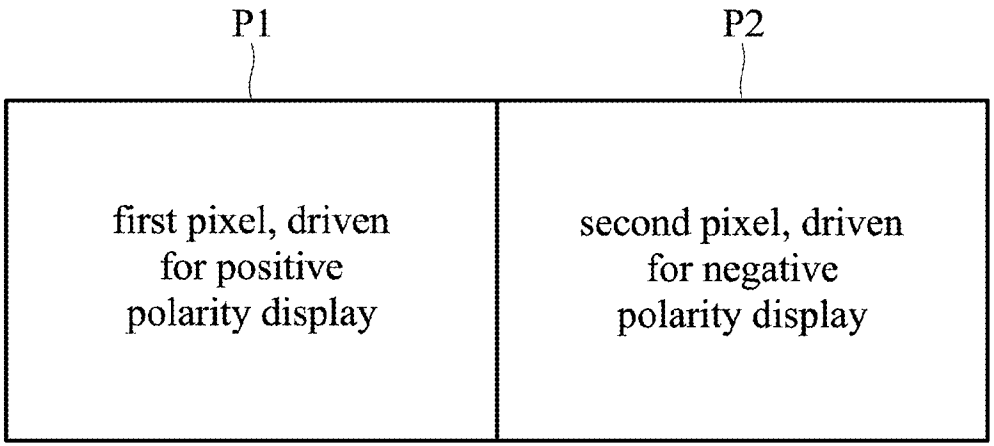
FIG. 3A shows two adjacent pixels, on the same row and adjacent columns, of the liquid crystal pixel array 202.

FIG. 3A shows two adjacent pixels of the liquid crystal pixel array 202. The two pixels are named a first pixel P1 and a second pixel P2, respectively, and are located on the same row and two adjacent columns of the liquid crystal pixel array 202. In a previous frame, the first pixel P1 is of negative polarity and the second pixel P2 is of positive polarity, and, in the new frame (the current frame), the first pixel P1 is switched to a positive polarity and the second pixel P2 is switched to a negative polarity. To drive the first pixel P1 to show positive polarity display and to drive the second pixel P2 to show negative polarity display, a driving circuit is shown in FIG. 3B in which the power consumption is considerably reduced in comparison with conventional techniques.

Figure 3B:
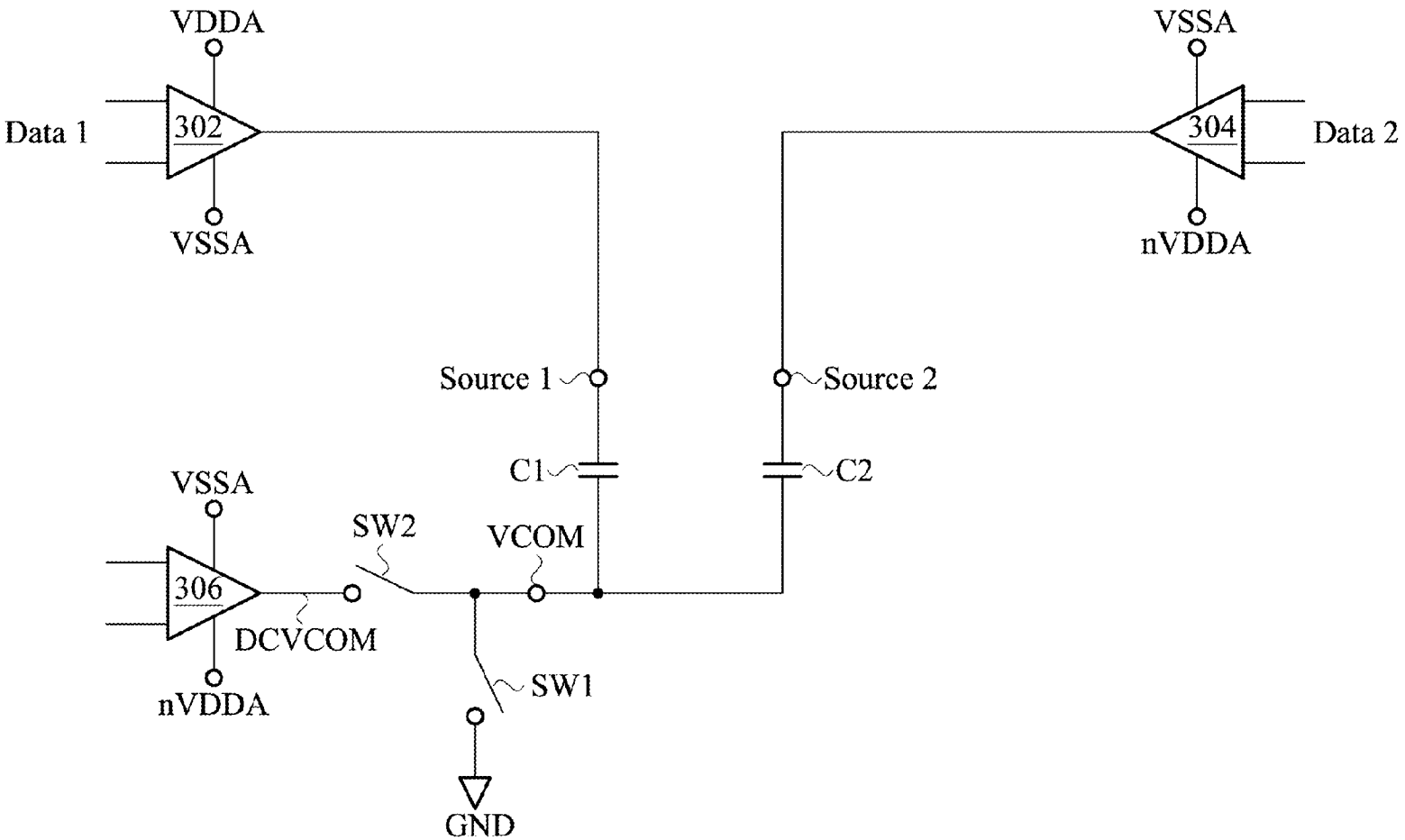
FIG. 3B uses two display capacitors C1 and C2 to represent the two adjacent pixels of FIG. 3A, and illustrates the essential driving circuit for the two adjacent pixels.

Referring to FIG. 3B, a first display capacitor C1 and a second display capacitor C2 are shown to represent the first pixel P1 and the second pixel P2 of FIG. 3A, respectively. The first display capacitor C1 may be a liquid crystal capacitor provided by the first pixel P1. The second display capacitor C2 may be a liquid crystal capacitor provided by the second pixel P2. A first terminal of the first display capacitor C1 is named Source1 while a first terminal of the second display capacitor C2 is named Source2, and, a second terminal of the first display capacitor C1 and a second terminal of the second display capacitor C2 are connected together to a VCOM terminal.

In addition to the first and second display capacitors C1 and C2, FIG. 3B further shows a first source operational amplifier 302, a second source operational amplifier 304, a VCOM source operational amplifier 306, a first switch SW1, and a second switch SW2.

The first and second source operational amplifiers 302 and 304 are provided by the source driver 208 shown in FIG. 2. To positively drive the first pixel P1 providing the first display capacitor Cl, the first source operational amplifier 302 may be powered by a positive supply voltage VDDA and a power ground VSSA, and a positive polarity display voltage Data1 is transmitted to the first source operational amplifier 302. When the first pixel P1 is scanned and a coupling between the positive polarity display voltage Data1 and the first terminal Source l of the first display capacitor Cl is allowed, the positive polarity display voltage Data1 is coupled to the first terminal Sourcel of a first display capacitor C1 by the first source operational amplifier 302 to charge the first display capacitor Cl for positive polarity display. To negatively drive the second pixel P2 providing the second display capacitor C2, the second source operational amplifier 304 may be powered by the power ground VSSA and a negative supply voltage nVDDA, and a negative polarity display voltage Data2 is transmitted to the second source operational amplifier 304. When the second pixel P2 is scanned and a coupling between the negative polarity display voltage Data2 and the first terminal Source2 of the second display capacitor C2 is allowed, the negative polarity display voltage Data2 is coupled to the first terminal Source2 of a second display capacitor C2 by the second source operational amplifier 304 to discharge the second display capacitor C2 for negative polarity display.

The VCOM operational amplifier 306, the first switch SW1 and the second switch SW2 of FIG. 3B are provided by the VCOM driver 210 of FIG. 2. With reference to FIG. 3B, the operation of the VCOM operational amplifier 306, the first switch SW1 and the second switch SW2 are discussed herein. The VCOM operational amplifier 306 may be powered by the power ground VSSA and the negative supply voltage nVDDA and is operative to output a constant voltage level DC VCOM. The first switch SW1 is designed to be turned on to ground the second terminals (VCOM) of the first and second display capacitors C1 and C2. The second switch SW2 is designed to be turned on to couple the constant voltage level DC VCOM provided by the VCOM operational amplifier 306 to the second terminals (VCOM) of the first and second display capacitors C1 and C2.

By determining when to allow coupling between the positive polarity voltage Data1 and the first terminal Source1 of the first display capacitor C1 and when to allow the coupling between the negative polarity voltage Data2 and the first terminal Source2 of the second display capacitor C2, and controlling the statuses of the first and second switches SW1 and SW2, the power consumption of the total driving circuit can be reduced. The timing controller 212 of FIG. 2 provides the timing schemes for the coupling between Data1 and Source1 and the coupling between Data2 and Source2 as well as provides the switch controls for the switches SW1 and SW2.

Figure 4:
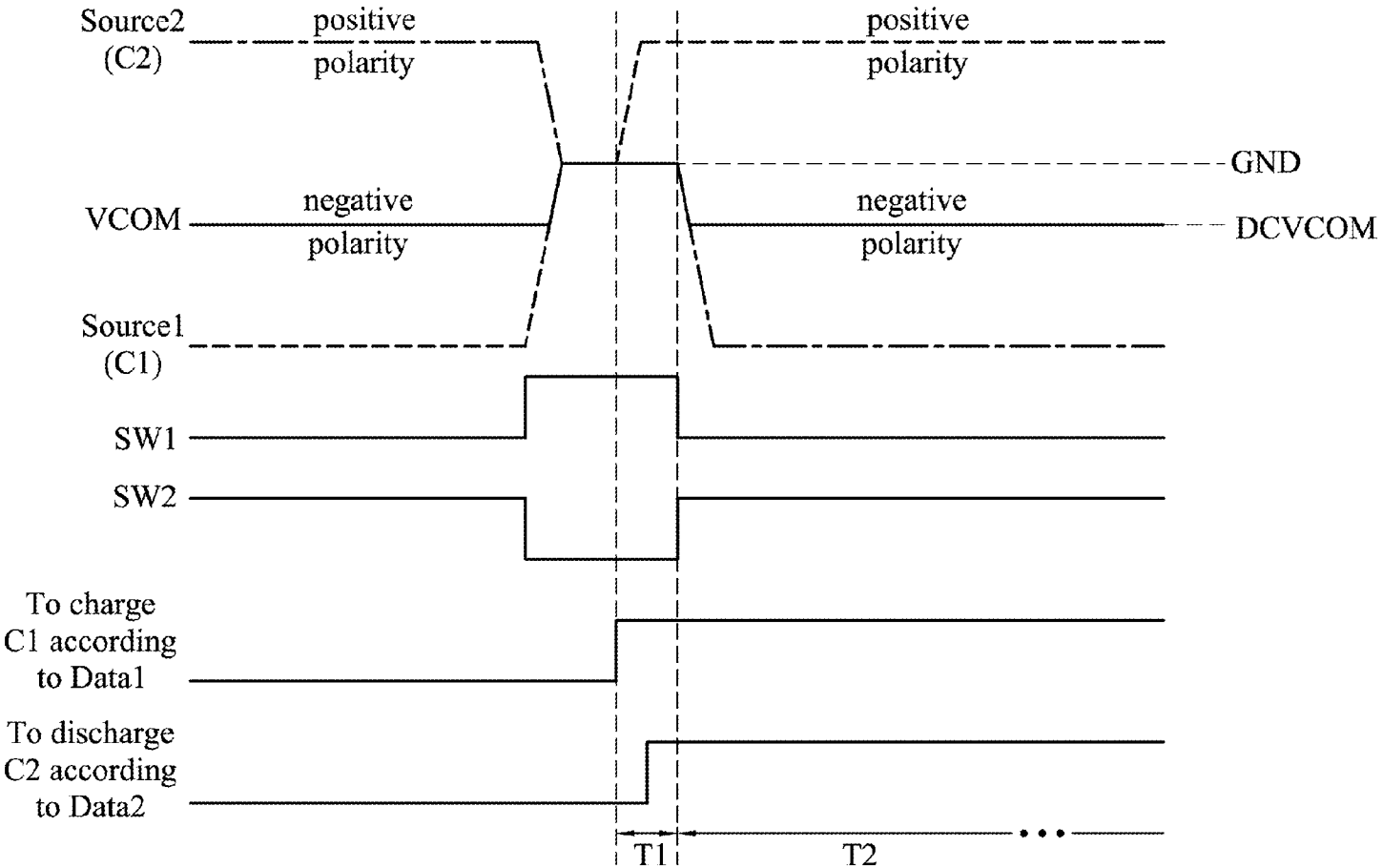
FIG. 4 are waveforms depicting the voltage levels of the terminals Source1, Source2 and VCOM, and the statuses of the first and second switches SW1 and SW2, and the timing of positive polarity charging of the first pixel P1 and the timing of the negative polarity discharging of the second pixel P2.

With reference to FIG. 3B, in FIG. 4 are waveforms depicting the voltage levels of the terminals Source1, Source2 and VCOM, and the statuses of the first and second switches SW1 and SW2, and the timing of positive polarity charging of the first pixel P1 and the timing of the negative polarity discharging of the second pixel P2.

As shown, the first switch SW1 is mostly turned off, the second switch SW2 is mostly turned on, and the voltage level of terminal VCOM is, for the most part, fixed at the constant level DCVCOM provided by the VCOM operational amplifier 306. When switching from a previous frame to a new frame, the terminal VCOM may be adjusted to a ground level GND by turning on the first switch SW1 and turning off the second switch SW2. The details are discussed in the following.

In the previous frame, the first terminal Source1 of the first display capacitor C1 is of negative polarity (lower than the voltage level at the terminal VCOM), and the first terminal Source2 of the second display capacitor C2 is of positive polarity (greater than the voltage level at the terminal VCOM). Before displaying a new frame, the first terminals Source1 and Source2 of the first and second display capacitors C1 and C2 may be ground to discharge the first and second display capacitors C1 and C2 for the subsequent polarity inversion process. In the meantime, the first switch SW1 may be turned on and the second switch may be turned off to ground the second terminals (VCOM) of the first and second display capacitors C1 and C2 so that the first and second display capacitors C1 and C2 may be discharged to a zero voltages.

After the terminals Source1, Source2 and VCOM are all adjusted to the ground level GND, the first and second pixels P1 and P2 providing the first and second display capacitors C1 and C2 may be scanned to display the new frame. When the first pixel P1 is scanned and it is enabled to charge the first display capacitor C1 according to the positive polarity display data Data1, a coupling between the positive polarity display voltage Data1 and the first terminal Source1 of the first display capacitor C1 is established by the first source operational amplifier 302. As shown, the display capacitor C1 is charged and the voltage level of first terminal Source1 of the first display capacitor C1 is raised for positive polarity display. When the array scanning proceeds to the next row, the coupling between the positive polarity display voltage Data1 and the first terminal Source1 of the first display capacitor C1 is broken, the voltage level of the terminal Source1 may stop rising and, in some embodiments, it is the time for which the first switch SW1 is turned off and the second switch SW2 is turned on to adjust the terminal VCOM back to the constant voltage level VCOM.

This paragraph discusses when to allow the coupling between the negative polarity display voltage Data2 and the first terminal Source2 of the second display capacitor C2, to discharge the second display capacitor C2 according to the negative polarity display voltage Data2. With reference to the bottom waveform of FIG. 4, it shows that the coupling between the negative polarity display voltage Data2 and the first terminal Source2 of the second display capacitor C2 may be established by the second source operational amplifier 304 after the positive-polarity display voltage Data1 has been coupled to the first terminal Source1 of the first display capacitor C1 for a while. As shown, the voltage level of the terminal Source2 is pulled down for negative-polarity display accordingly. To summarize, when the row of the first and second display capacitors C1 and C2 are scanned to display the new frame, the coupling between the positive polarity display voltage Data1 and the terminal Source1 may be established earlier than the coupling established between the negative display voltage Data2 and the terminal Source2.

The following paragraphs discuss why the control scheme instructed in FIG. 4 can dramatically reduce power consumption. For simplicity, the charging path of the first display capacitor C1 of the first pixel P1 is used as an example.

Figure 5B:
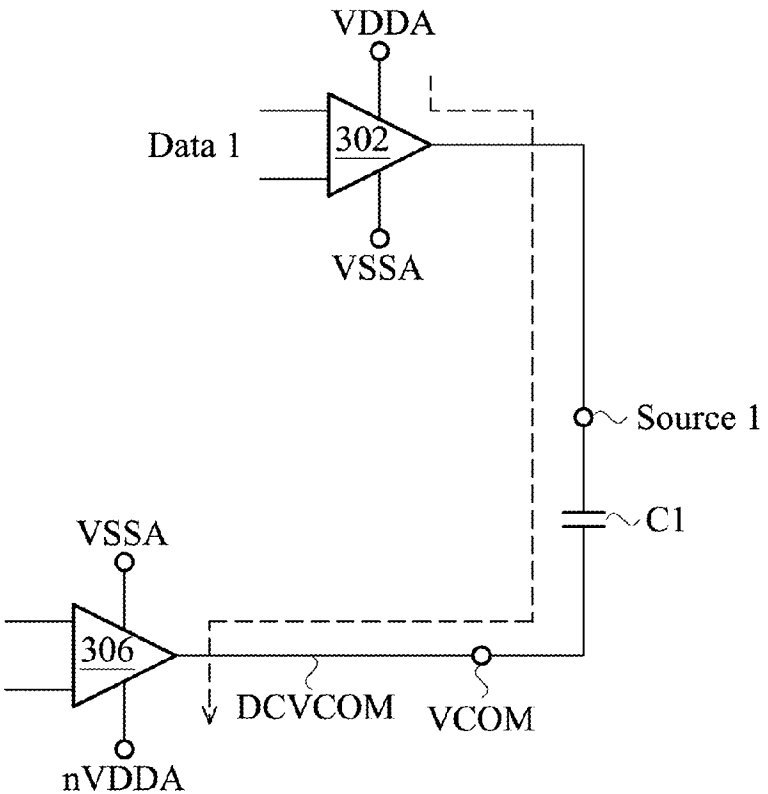
FIG. 5B shows a charging path of the first display capacitor C1 when the first switch SW1 is tuned off and the second switch SW2 is turned on and a coupling between the positive polarity display voltage Data1 and the terminal Source1 is established.
Figure 5A:
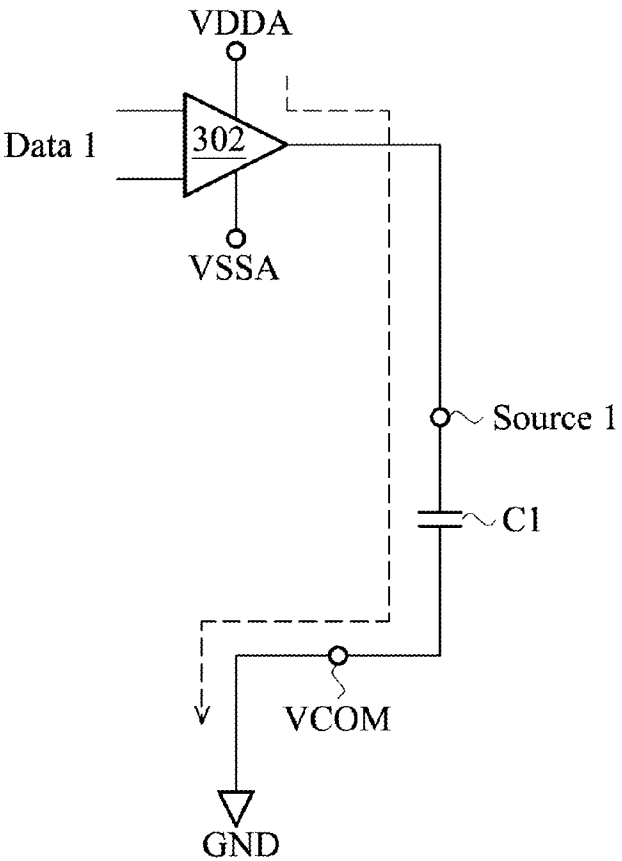
FIG. 5A shows a charging path of the first display capacitor C1 when the first switch SW1 is turned on and the second switch SW2 is turned off and a coupling between the positive polarity display voltage Data1 and the terminal Source1 is established.

In a case wherein a coupling between the positive polarity display voltage Data1 and the first terminal Source1 of the first display capacitor C1 is established, FIG. 5A shows the charging path of the first display capacitor C1 when the first switch SW1 is turned on and the second switch SW2 is turned off, and FIG. 5B shows the charging path of the first display capacitor C1 when the first switch SW1 is tuned off and the second switch SW2 is turned on.

Referring to FIG. 5A, corresponding to the time interval T1 of FIG. 4, the charging current flows from the positive supply voltage VDDA of the first source operational amplifier 302 to the first display capacitor C1 and finally to the ground level GND. In this regard, when charging the terminal Source1 from the ground level GND to the positive polarity level, the VCOM operational amplifier 306 is not involved in the current path, and so that the voltage difference of the charging path is (VDDA-GND), much smaller than (VDDA-nVDDA). Thus, power consumption is reduced.

In the case of FIG. 5B, corresponding to the time interval T2 of FIG. 4, the charging current flows from the positive supply voltage VDDA of the first source operational amplifier 302 to the first display capacitor C1 and finally to the VCOM operational amplifier 306 to the negative supply voltage nVDDA thereof. Although a huge voltage difference, from the positive supply voltage VDDA of the first source operational amplifier 302 to the negative supply voltage nVDDA of the VCOM operational amplifier 306, exists in the charging path, the capacitor charging still does not consume much power because only a small voltage modification, from a ground level GND to a DCVCOM, is required by the VCOM terminal. Thus, power is minimized when compared to conventional techniques.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving circuit for a liquid crystal pixel array, comprising:

a source driver comprising a first source operational amplifier, wherein the first source operational amplifier couples a positive polarity display voltage to a first terminal of a first display capacitor of the liquid crystal pixel array when a first pixel, within the liquid crystal pixel array and providing the first display capacitor, is scanned for positive polarity display and a coupling between the positive polarity display voltage and the first terminal of the first display capacitor is allowed;

a VCOM driver, comprising:

a VCOM operational amplifier, outputting a DC VCOM, wherein the VCOM operational amplifier is powered by a power ground and a negative supply voltage;

a first switch to be turned on to couple a second terminal of the first display capacitor to a ground; and a second switch, to be turned on to couple the DC VCOM to the second terminal of the first display capacitor; and a timing controller, determining when to allow the coupling between the positive polarity display voltage and the first terminal of the first display capacitor and controlling statuses of the first and second switches to reduce power consumption of the driving circuit.

2. The driving circuit as claimed in claim 1, wherein:

the timing controller turns on the first switch and turns off the second switch when the coupling between the positive polarity display voltage and the first terminal of the first display capacitor is established; and the timing controller keeps turning on the first switch and keeps turning off the second switch until the coupling between the positive polarity display voltage and the first terminal of the first display capacitor is broken.

3. The driving circuit as claimed in claim 2, wherein the timing controller further turns on the first switch and turns off the second switch to discharge the first display capacitor to a zero voltage.

4. The driving circuit as claimed in claim 1, wherein:

the first source operational amplifier is powered by a positive supply voltage and the power ground.

5. The driving circuit as claimed in claim 1, wherein:

the source driver further comprises a second source operational amplifier, wherein the second source operational amplifier couples a negative polarity display voltage to a first terminal of a second display capacitor of the liquid crystal pixel array when a second pixel, within the liquid crystal pixel array and providing the second display capacitor, is scanned for negative polarity display and a coupling between the negative polarity display voltage and the first terminal of the second display capacitor is allowed;

the VCOM driver is further coupled to a second terminal of the second display capacitor by an electrical connection between the second terminal of the first display capacitor and the second terminal of the second display capacitor; and the timing controller further determines when to allow the coupling between the negative polarity display voltage and the first terminal of the second display capacitor.

6. The driving circuit as claimed in claim 5, wherein:

the timing controller turns on the first switch and turns off the second switch when the coupling between the positive polarity display voltage and the first terminal of the first display capacitor is established; and the timing controller keeps turning on the first switch and keeps turning off the second switch until the coupling between the positive polarity display voltage and the first terminal of the first display capacitor is broken.

7. The driving circuit as claimed in claim 6, wherein, after the coupling between the positive polarity display voltage and the first terminal of the first display capacitor is broken, the timing controller allows the coupling between the negative polarity display voltage and the first terminal of the second display capacitor.

8. The driving circuit as claimed in claim 7, wherein the timing controller further turns on the first switch and turns off the second switch to discharge the first and second display capacitors to a zero voltages.

9. The driving circuit as claimed in claim 5, wherein:

the first source operational amplifier is powered by a positive supply voltage and the power ground to couple the positive polarity display voltage to the first terminal of the first display capacitor; and the second source operational amplifier is powered the power ground and the negative supply voltage to couple the negative polarity display voltage to the first terminal of the second display capacitor.

10. A liquid crystal display, comprising:

the driving circuit of claim 1; and the liquid crystal pixel array driven by the driving circuit.

* * * * *